US008753503B2

(12) United States Patent
Krupa et al.

(10) Patent No.: US 8,753,503 B2
(45) Date of Patent: Jun. 17, 2014

(54) PROCESS AND APPARATUS FOR PRODUCING A REFORMATE BY INTRODUCING ISOPENTANE

(75) Inventors: Steven L. Krupa, Fox River Grove, IL (US); Mark P. Lapinski, Aurora, IL (US); Clayton C. Sadler, Arlington Heights, IL (US)

(73) Assignee: UOP LLC, Des Plaines, IL (US)

( * ) Notice: Subject to any disclaimer, the term of this patent is extended or adjusted under 35 U.S.C. 154(b) by 1512 days.

(21) Appl. No.: 12/179,524

(22) Filed: Jul. 24, 2008

(65) Prior Publication Data

US 2010/0018899 A1 Jan. 28, 2010

(51) Int. Cl.
*C10G 35/00* (2006.01)

(52) U.S. Cl.
USPC ..... 208/133; 208/134; 208/137; 208/138; 208/141; 208/63; 208/64; 208/65; 208/66

(58) Field of Classification Search
USPC ..... 208/133, 134, 137, 138, 141, 63–66
See application file for complete search history.

(56) References Cited

U.S. PATENT DOCUMENTS

| | | | | |
|---|---|---|---|---|
| 2,530,875 | A * | 11/1950 | Gwynn et al. | 585/736 |
| 2,885,347 | A * | 5/1959 | Hemminger | 208/138 |
| 4,432,862 | A * | 2/1984 | Swart et al. | 208/134 |
| 4,469,911 | A | 9/1984 | Manning | |
| 4,615,793 | A | 10/1986 | Jossens | |
| 4,899,008 | A | 2/1990 | LaPierre | |
| 5,354,451 | A | 10/1994 | Goldstein et al. | |
| 5,877,372 | A | 3/1999 | Evans et al. | |
| 5,895,830 | A | 4/1999 | Stine et al. | |
| 5,925,799 | A | 7/1999 | Stanley et al. | |
| 6,123,834 | A | 9/2000 | Kao et al. | |
| 6,156,950 | A | 12/2000 | Ragil et al. | |
| 6,338,791 | B1 | 1/2002 | Ragil et al. | |
| 6,576,588 | B2 | 6/2003 | Ryu et al. | |
| 6,689,927 | B1 | 2/2004 | Frame et al. | |
| 2003/0028059 | A1 | 2/2003 | Hamper | |
| 2006/0102520 | A1 | 5/2006 | Lapinski et al. | |

FOREIGN PATENT DOCUMENTS

| | | | |
|---|---|---|---|
| EP | 1 201 730 | A1 | 5/2002 |
| RU | 2 144 942 | C1 | 1/2000 |
| WO | WO-98/58041 | | 12/1998 |
| WO | WO-2006/083746 | A1 | 8/2006 |

(Continued)

OTHER PUBLICATIONS

Dachos et al., UOP Platforming Process, Handbook of Petroleum Refining Processes, vol. 2nd Edition, Publisher: Robert A. Meyers, 1997, p. 4.3-4.26.

(Continued)

*Primary Examiner* — Randy Boyer
*Assistant Examiner* — Michelle Stein
(74) *Attorney, Agent, or Firm* — Maryann Maas

(57) ABSTRACT

One exemplary embodiment can be a process for producing a reformate by combining a stream having an effective amount of isopentane and a stream having an effective amount of naphtha for reforming. Generally, the naphtha has not less than about 95%, by weight, of one or more compounds having a boiling point of about 38-about 260° C. as determined by ASTM D86-07. The process may include introducing the combined stream to a reforming reaction zone. The combined stream can have an isopentane:naphtha mass ratio of about 0.10:1.00-about 1.00:1.00.

18 Claims, 7 Drawing Sheets

(56) References Cited

FOREIGN PATENT DOCUMENTS

| | | | |
|---|---|---|---|
| WO | WO-2006/133908 | A2 | 12/2006 |
| WO | WO-2007/057151 | A2 | 5/2007 |
| WO | WO-2007/057153 | A1 | 5/2007 |

OTHER PUBLICATIONS

Klerk, Properties of Synthetic Fuels from H-ZSM-5 Oligomerization of Fischer-Tropsch Type Feed Materials, Energy & Fuels, vol. 2007, No. 21, Publisher: American Chemical Society, Sep. 21, 2007, pp. 3084-3089.

Schmidt et al., Oligomerization of C5 Olefins in Light Catalytic Naphtha, Energy & Fuels, vol. 2008, No. 22, Publisher: American Chemical Society, Feb. 28, 2008, pp. 1148-1155.

Patent Application Entitled, "Process and Apparatus for Producing a Reformate by Introducing n-Butane" filed Jul. 24, 2008.

Patent Application Entitled, "Process and Apparatus for Producing a Reformate by Introducing Methane" filed Jul. 24, 2008.

* cited by examiner

PROCESS AND APPARATUS FOR PRODUCING A REFORMATE BY INTRODUCING ISOPENTANE

FIELD OF THE INVENTION

This invention generally relates to a process and an apparatus for producing a reformate.

DESCRIPTION OF THE RELATED ART

Generally, naphtha reforming can produce a product, typically highly aromatic, for use as a gasoline, a gasoline blending component, or a feedstock to produce other petrochemicals. Typically, the reforming process produces significant levels of lighter C1-C5 byproducts, such as ethane, propane, butane, and pentane. The C5 (one or more hydrocarbons with five carbon atoms) produced can be included in the fractionated product.

Recently, government regulations have required increased blending of ethanol into gasoline produced in the United States. The high blending vapor pressure of ethanol can require reducing the vapor pressure of the gasoline so that the final gasoline product meets regulatory requirements. The C5 in the gasoline can be a significant contributor to the vapor pressure of the gasoline. Consequently, there is a desire to reduce the level of C5 in the gasoline product. In addition, it is generally desirable to produce the gasoline product by minimizing the amounts of C5 components and increase the yield of desired aromatic products.

Thus, it would be desirable to provide an apparatus and/or a process for producing a gasoline that can minimize the production of C5 while maximizing the production of desired gasoline components.

SUMMARY OF THE INVENTION

One exemplary embodiment can be a process for producing a reformate by combining a stream having an effective amount of isopentane and a stream having an effective amount of naphtha for reforming. Generally, the naphtha has not less than about 95%, by weight, of one or more compounds having a boiling point of about 38-about 260° C. as determined by ASTM D86-07. The process may include introducing the combined stream to a reforming reaction zone. The combined stream can have an isopentane:naphtha mass ratio of about 0.10:1.00-about 1.00:1.00.

Another exemplary embodiment may be a reforming apparatus for producing a reformate. The reforming apparatus can include a reforming reaction zone and a fractionation zone. Generally, the reforming reaction zone is adapted to receive a stream rich in isopentane and a stream rich in naphtha having a boiling range of about 38-about 260° C. Typically, the fractionation zone produces a stream rich in a C5 hydrocarbon. The isopentane can be at least partially recycled to the reforming reaction zone.

A further exemplary embodiment can be a process. The process can include combining a stream substantially of isopentane and a stream substantially naphtha introduced to a reforming reaction zone. Generally, the naphtha has not less than about 95%, by weight, of one or more compounds having a boiling point of about 38-about 260° C. as determined by ASTM D86-07.

The embodiments disclosed herein can provide a reduction in the production of C5 by co-feeding isopentane. Thus, the vapor pressure of a gasoline product may be lowered. In addition, co-feeding isopentane may also increase the production of some heavier aromatics. In addition, co-feeding isopentane may be more advantageous as compared to co-feeding other light hydrocarbons.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. Similarly, aromatic compounds may be abbreviated A6, A7, A8 . . . . An where "n" represents the number of carbon atoms in the one or more aromatic molecules. Also, isopentane can be abbreviated iC5 and normal pentane nC5. Furthermore, a superscript "+" or "−" may be used with an abbreviated one or more hydrocarbons notation, e.g., $C3^+$ or $C3^-$, which is inclusive of the abbreviated one or more hydrocarbons. As an example, the abbreviation "$C3^+$" means at least one hydrocarbon molecule of three and/or more carbon atoms.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "rich" can mean an amount of generally at least about 50%, and preferably about 70%, by mole, of a compound or class of compounds in a stream.

As used herein, the term "substantially" can mean an amount of generally at least about 80%, preferably about 90%, and optimally about 99%, by mole, of a compound or class of compounds in a stream.

As used herein, the term "isopentane" can mean 2-methylbutane.

DETAILED DESCRIPTION

Figure 1:
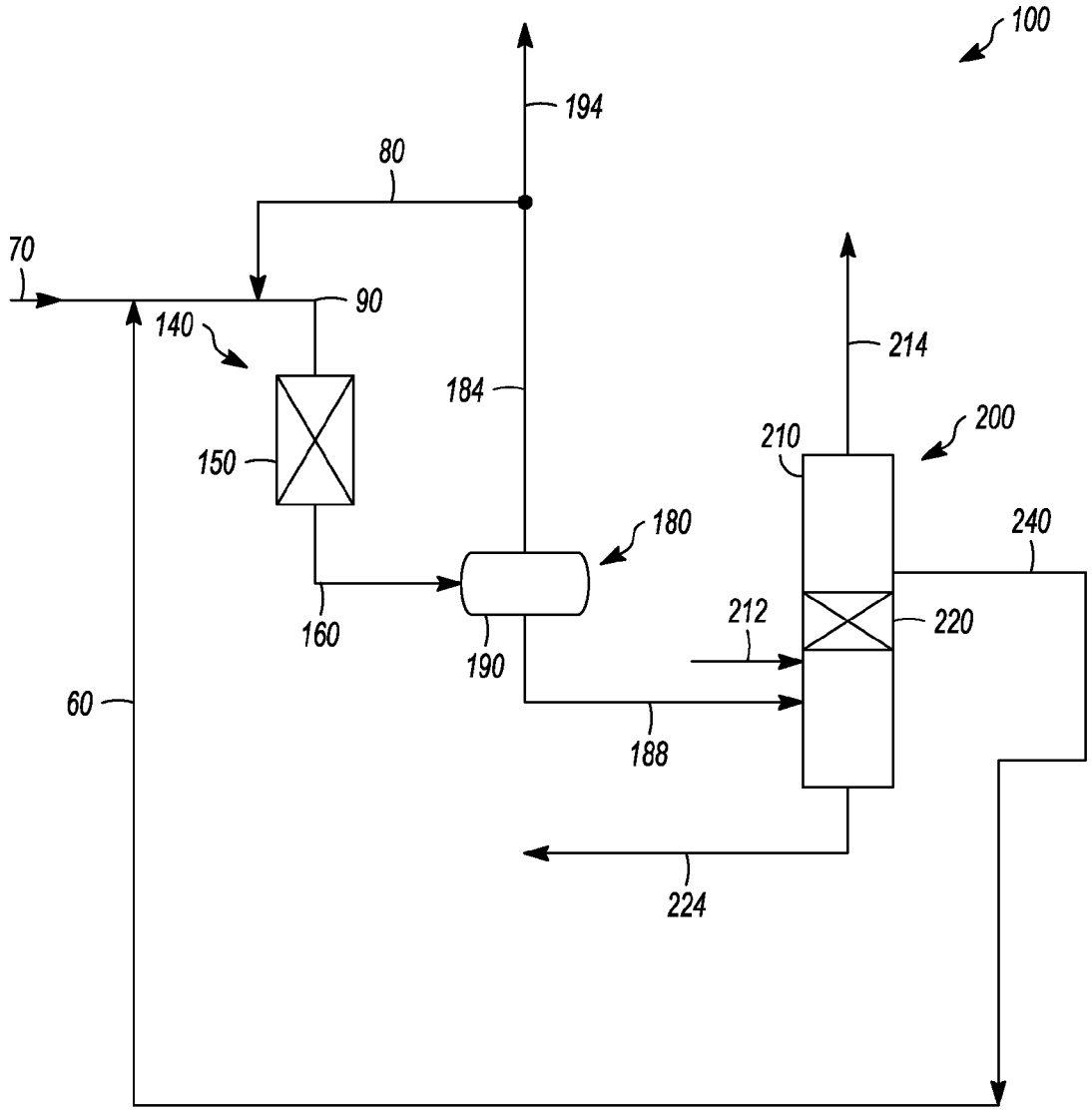
FIG. 1 is a schematic depiction of an exemplary reforming apparatus.

Referring to FIG. 1, a reforming apparatus 100 can include a reforming reaction zone 140, a separation zone 180, and a fractionation zone 200. The reforming reaction zone 140 can receive a combined stream 90. The combined stream 90 may include a stream 60 including an effective amount of isopentane (hereinafter described in more detail) for reforming, a stream 70 including an effective amount of naphtha for reforming, and a stream 80 including an effective amount of hydrogen (hereinafter described in more detail) for reforming. Typically, the streams 60, 70, and 80 are rich in, respectively, isopentane, naphtha, and hydrogen. The naphtha stream 70 can have at least 95%, by weight, of one or more compounds having a boiling point of about 38-about 260° C. The isopentane stream 60 can either be obtained from another process, i.e., such as an external supply, or recovered from the downstream vessels as hereinafter described. In either case, it is generally desired to recover and/or recycle the isopentane.

The stream 80 including hydrogen can include any suitable amount of hydrogen, and preferably is rich in hydrogen. Generally, the hydrogen stream 80 can be obtained from any suitable source, either an external source or hydrogen recycled from downstream units. The combined stream 90 can contain sufficient amounts of isopentane to reduce the production of C5 in the reformate. Generally, the combined stream 90 has an isopentane:naphtha mass ratio of about 0.10:1.00-about 1.00:1.00, preferably 0.20:1.00-about 0.50:1.00. Generally, the hydrogen to naphtha mole ratio can be about 10 or less, and preferably about 2-about 8. The combined stream can enter the reforming reaction zone 140.

The reforming reaction zone 140 can include at least one reforming reactor 150, preferably a plurality of reforming reactors operating in serial and/or parallel. The reforming reaction zone 140 can operate under any suitable conditions and include any suitable equipment. An exemplary reforming reaction zone 140 is disclosed by Dachos et al., *UOP Platforming Process*, Chapter 4.1, Handbook of Petroleum Refining Processes, editor Robert A. Meyers, 2nd edition, pp. 4.1-4.26 (1997). The reforming reaction can dehydrogenate compounds such as naphthenes, can isomerize paraffins and naphthenes, can dehydrocyclize paraffins, and/or hydrocrack and dealkylate paraffins. The reforming reaction zone 140 can include other equipment such as furnaces and a combined feed heat exchanger.

The reforming reforming reactor 150 can contain any suitable catalyst. One preferred catalyst can include a platinum-group component, a tin component, and a support component including an inorganic oxide binder. Such a catalyst is disclosed in US 2006/0102520 A1.

In one exemplary embodiment, the at least one reforming reactor 150 can operate at a temperature of about 300-about 550° C., preferably about 470-about 550° C., and optimally about 500-about 550° C. In some instances, a higher temperature may be of benefit. In addition, the at least one reactor 150 can operate at a pressure of about 340-about 5,000 kPa, and a liquid hourly space velocity (LHSV) based on a naphtha feed of about 0.1-about 20 $hr^{-1}$, preferably about 0.5-about 5.0 $hr^{-1}$ based on the naphtha stream 70. Afterwards, a reforming reaction zone effluent 160 can exit the reforming reaction zone 140.

The reforming reaction zone effluent 160 can travel to a separation zone 180 including a separator 190. The gasses can escape upwards in a first stream 184 from the separation zone 180 and be distributed in any suitable manner using a fluid transfer device, such as a compressor. The gas can include a significant amount of hydrogen and as such, at least a portion of this gas can be recycled as the hydrogen stream 80 to be combined with the naphtha stream 70 and the isopentane stream 60. Generally, the excess hydrogen containing gas produced in the reforming reactor 150 is removed from the reforming apparatus 100 via a hydrogen product stream 194 and can be used, e.g., in other parts of a refinery or a petrochemical complex. Typically, a heavier, second stream 188, including one or more liquids, preferably rich in one or more liquids, can pass out the bottom of the separator 190 and can be provided to the fractionation zone 200.

The fractionation zone 200 can include a column 210, although any number of columns may be utilized in series or parallel operation. The column 210 can include a C5 hydrogenation reactive distillation zone 220. The column 210 can further receive a stream 212 having an effective amount of hydrogen to facilitate reactions in the C5 hydrogenation reactive distillation zone 220. Typically, the stream 212 is rich in hydrogen. The C5 reactive distillation zone 220 can be any suitable reactive distillation zone as known by those of skill in the art including those disclosed in U.S. Pat. No. 6,576,588 B2 and U.S. Pat. No. 5,925,799. The hydrogenation reactive distillation zone 220 can convert C5 olefins into isopentane and n-pentane. The column 210 can produce a stream 214 including, preferably rich in, $C4^-$, a side-stream 240 including, preferably rich in, isopentane, and a bottom stream 224 including, preferably rich in, $C6^+$, which can be provided to the gasoline pool. The side-stream 240 can either be sent to other units for processing or can be recycled, preferably as the isopentane stream 60 to be combined with the naphtha stream 70.

Figure 2:
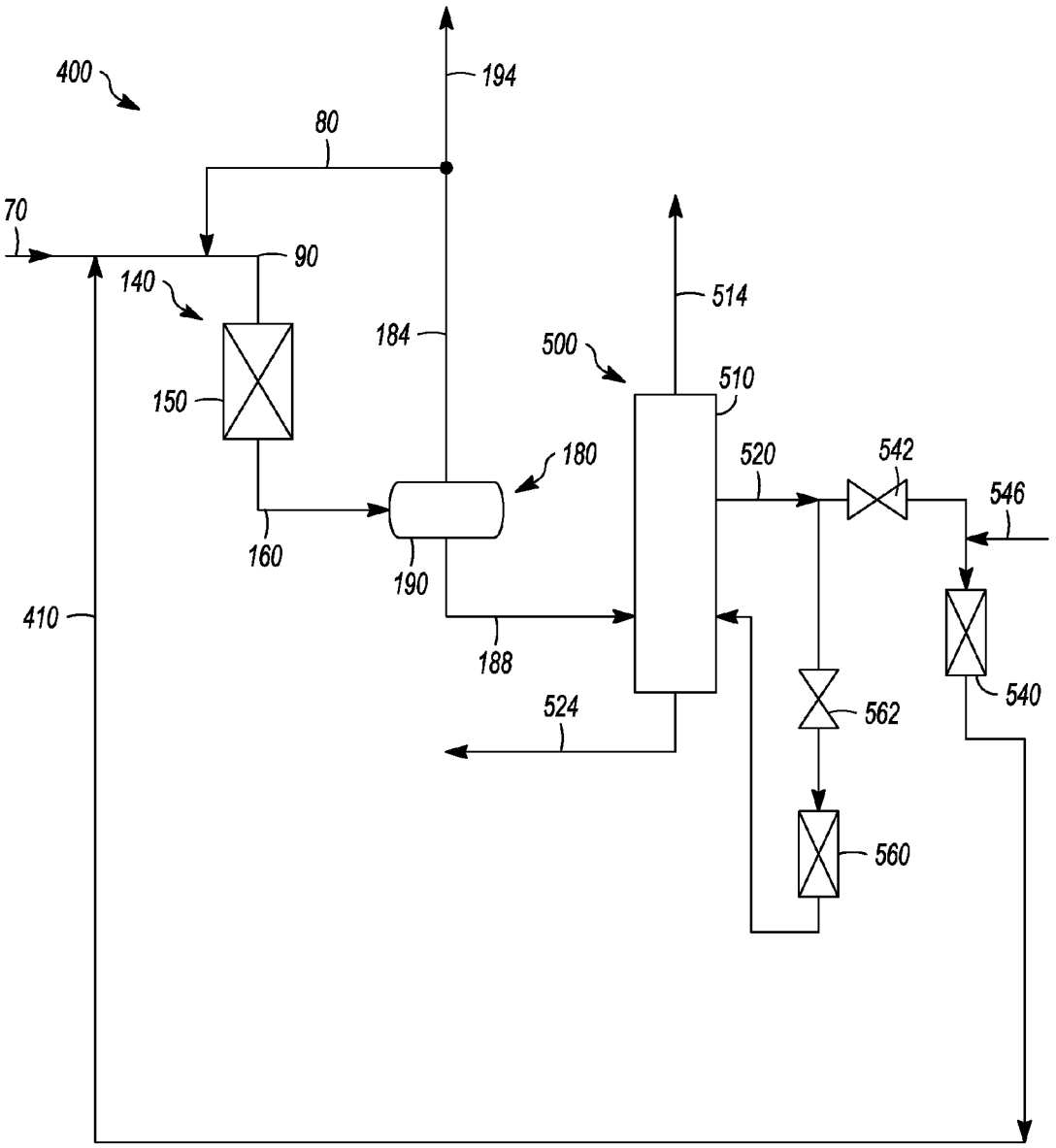
FIG. 2 is a schematic depiction of another exemplary reforming apparatus.

Referring to FIG. 2, another reforming apparatus 400 can include the reforming reaction zone 140, the separation zone 180, a fractionation zone 500, a hydrogenation zone 540, and an oligomerization reaction zone 560. The reforming reaction zone 140 and the separation zone 180 can be similar as described above. Particularly, the reforming reaction zone 140 can receive the combined stream 90, which can include a stream 410 including an effective amount of isopentane (described in further detail) for reforming, the naphtha stream 70 (as described above), and the stream 80 (as described above). The stream 410 including, preferably rich in, isopentane, can be similar to the isopentane stream 60 (as described above), except that other downstream units can provide the isopentane stream 410 (as described below).

The one or more liquids stream 188 from the separation zone 180 can be provided to the fractionation zone 500. The fractionation zone 500 can include at least one column 510, although one or more columns may be present. The column 510 can be a debutanizer or a C5 recovery column. The column 510 can produce a stream 514 including, preferably rich in, $C4^-$, a side-stream 520 including, preferably rich in, C5 olefin, and a stream 524 including, preferably rich in, $C6^+$. The side-stream 520 can enter a hydrogenation zone 540 and/or an oligomerization reaction zone 560. In this exemplary embodiment, both zones 540 and 560 are present, but it should be understood that only one zone 540 or 560 may be present. If only the oligomerization zone 560 is present, then the isopentane may need to be supplied from an external source. The valves 542 and 562 can regulate the amount of the side-stream 520 that enters, respectively, the hydrogenation zone 540 and/or the oligomerization zone 560.

If the valve 562 is closed and the valve 542 opened, generally the hydrogenation zone 540 is adapted to completely hydrogenate the C5 olefin side-stream 520 removed from the column 510. The C5 olefin side-stream 520 can be obtained by taking a side cut from the column 510. The hydrogenation zone 540 can be a complete saturation process that converts substantially all the C5 olefins to C5 paraffins. Particularly, the side-stream 520 can be rich in olefins and the hydrogenation zone 540 can be adapted using sufficient amounts of hydrogen, and selecting a catalyst effective for olefin saturation and/or process parameters, i.e., temperature and pressure, to saturate the olefins to convert them to paraffins. Desirably, the resulting stream 410 includes, preferably is rich in, isopentane, and is recycled as the isopentane stream 410 to be comprised in the combined stream 90.

Alternatively, if the valve 542 is closed and the valve 562 opened, the side-stream 520 can enter the oligomerization reaction zone 560. The oligomerization reaction zone 560 can be sufficient to convert the C5 olefins into larger compounds, such as C10. As such, a C5 olefin dimerization reactor in the oligomerization reaction zone 560 can operate under similar conditions as other oligomerization processes, such as for C4 olefins, as disclosed in U.S. Pat. No. 4,469,911; U.S. Pat. No. 5,877,372; U.S. Pat. No. 5,895,830; and U.S. Pat. No. 6,689,927 B1. An exemplary C5 olefin dimerization process is disclosed in Schmidt et al., *Oligomerization of C5 Olefins in Light Catalytic Naphtha, Energy & Fuel*, vol. 22, pages 1148-1155 (2008). Subsequently, the effluent from the oligomerization reaction zone 560 can be returned to the column 510 and the oligomerization reaction zone product, such as C10, can exit the bottom of the column 510 into the $C6^+$ stream 524 to be sent to the gasoline pool.

EXAMPLES

The following examples are intended to further illustrate the disclosed embodiments. These illustrations of the embodiments are not meant to limit the claims to the particular details of these examples. These examples can be based on engineering calculations and actual operating experience with similar processes.

Tests are conducted of comparing a co-feed of methane and naphtha, and a co-feed of isopentane and naphtha, which may be referred to as, respectively, a co-feed of methane and a co-feed of isopentane. Each test is conducted in a pilot plant using the same reforming catalyst made in accordance with US 2006/0102520 A1. The pilot plant is operated to minimize catalyst de-activation during the test. The catalyst has a chloride content of about 1% by weight. The feedstock is a commercial naphtha with an endpoint of 160° C. The methane and isopentane are provided as pure components. The feed contains 1.1 weight ppm sulfur on a naphtha plus methane basis, or a naphtha plus isopentane basis for the respective methane and isopentane co-feed tests. These conditions can provide a sulfur level at the reactor inlet typical of a commercial unit reactor. The temperature of the reactor is varied from 510-540° C. to obtain performance data at different conversion levels of the feedstock. The parameters for the co-feed of methane and isopentane are depicted below in Table 1:

TABLE 1

| Parameter | C1 Co-Feed | iC5 Co-Feed |
|---|---|---|
| C1 or iC5 to Naphtha Mass Ratio (gram/gram) | 0.072 | 0.33 |
| C1 or iC5 to Naphtha Mole Ratio (mole/mole) | 0.488 | 0.488 |
| LHSV on Naphtha ($hr^{-1}$) | 2.75 | 2.75 |
| LHSV on Naphtha + iC5 ($hr^{-1}$) | Not Applicable | 3.82 |
| Hydrogen:Hydrocarbon Mole Ratio Based on Naphtha (mole/mole) | 8.0 | 8.0 |
| Hydrogen:Naphtha + iC5 Mole Ratio (mole/mole) | 5.4 | 8.0 |
| Pressure (kPa) | 446 | 446 |

The following formula is used to calculate the yield of, respectively, methane, isopentane, and hydrogen (each "selected species" collectively abbreviated "ss") in the reactor product:

$$Y_{ss}=(P_{ss}-L_{ss})/N*100\%$$

$Y_{ss}$=net mass yield of methane, isopentane, or hydrogen based on a naphtha feed;

$P_{ss}$=mass flow of methane, isopentane, or hydrogen in the reactor effluent;

$L_{ss}$=mass flow of a methane or isopentane co-feed or hydrogen feed; and

N=mass flow of a naphtha feed.

The following formula is used to calculate the yield of species (i) in the reactor product where (i) is a component other than methane, isopentane, or hydrogen in the reactor effluent:

$$Y_i=P_i/N*100\%$$

$Y_i$=net mass yield of species based on a naphtha feed;

$P_i$=mass flow of species (i) in the reactor effluent; and

N=mass flow of a naphtha feed.

Referring to FIGS. 3-7, the yield of various compounds is compared for the co-feeds of methane (C1) and isopentane (iC5). Particularly, the yield by weight percent is plotted versus C7 paraffin conversion. The yields for co-feeding isopentane are calculated using the same experimental computations and statistical methods, and are compared against a baseline of co-feeding methane with the naphtha. The methane co-feed test is used as a reference to ensure that the same naphtha residence time in the reactor and the same hydrogen partial pressure are used in both experiments. Use of the methane co-feed in the reference experiment allows for these process variables to be held constant while using methane with minimal reactivity under reforming conditions. With these process variables controlled, any yield differences can be attributed to the effect of isopentane on the reactions in the reforming reaction zone. A line of best fit is drawn through some of the data points.

Figure 3:
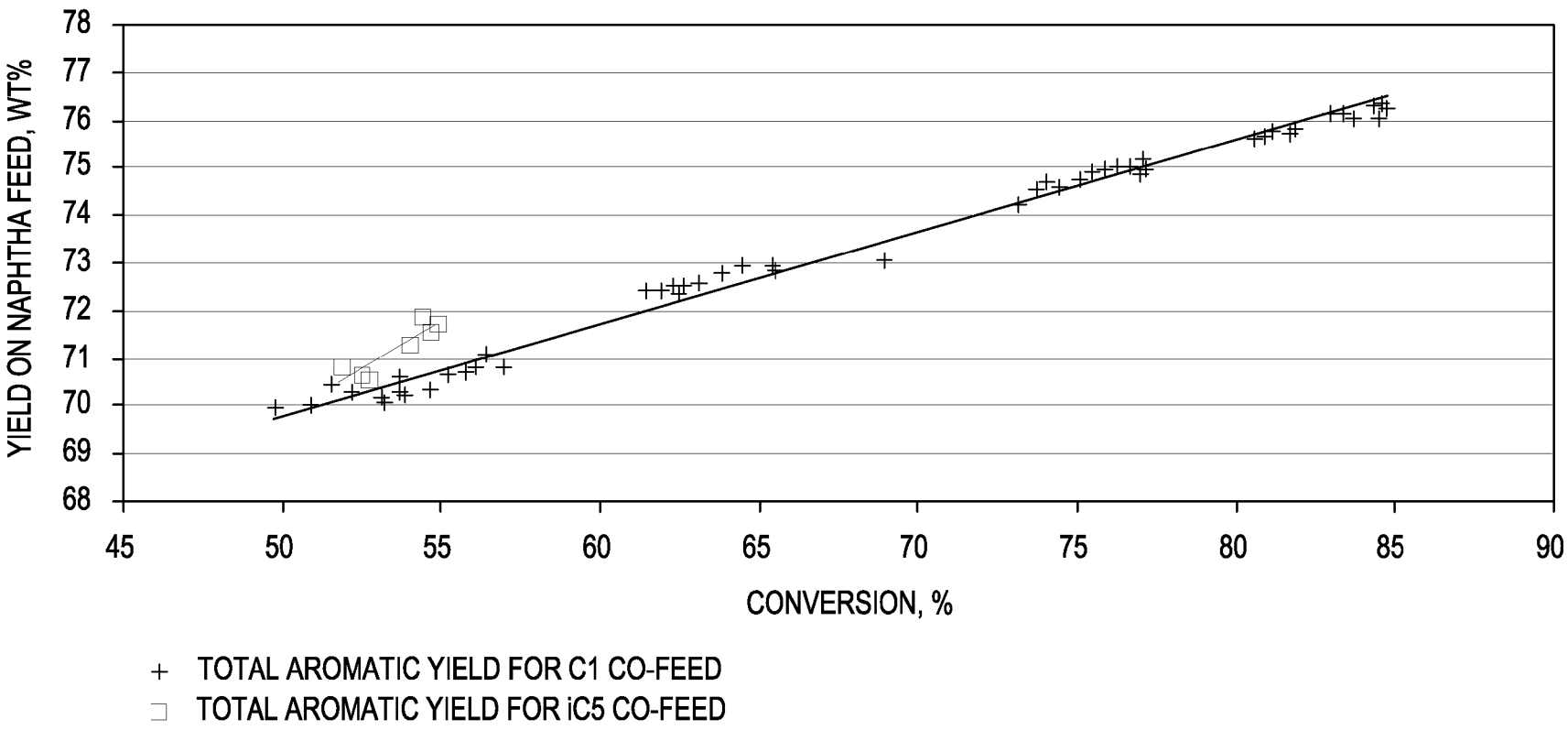
FIG. 3 is a graphical depiction of total aromatic yield versus C7 paraffin conversion.

Referring to FIG. 3, a comparison is made of the total yield of aromatics by a co-feed of methane and a co-feed of isopentane. The co-feed of isopentane generally yields higher aromatics as compared to the co-feed of methane. Increasing the total yield of aromatics is generally desired for the reformate.

Figure 4:
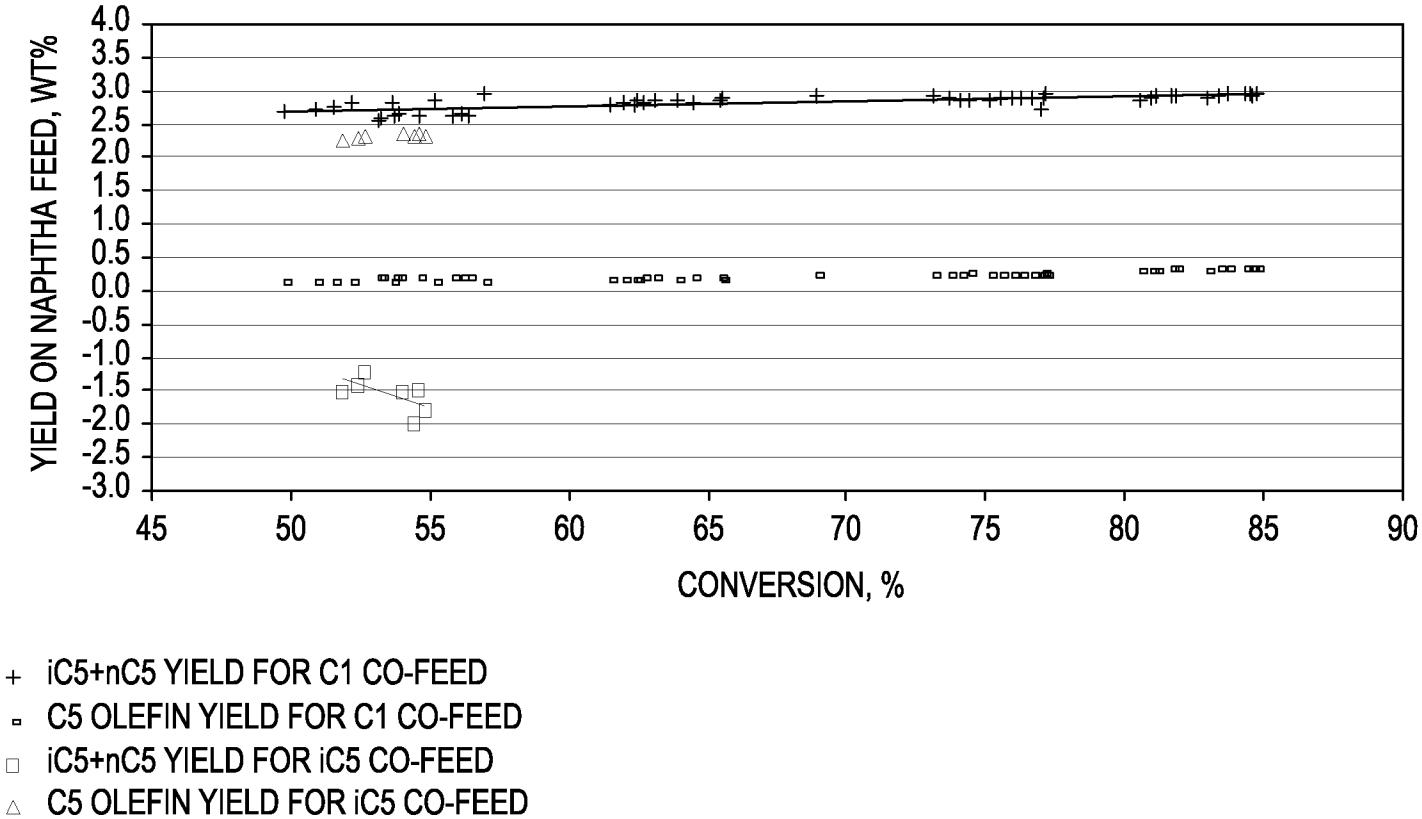
FIG. 4 is a graphical depiction of (iC5+nC5) and C5 olefin yield versus C7 paraffin conversion.

Referring to FIG. 4, a comparison is made of the yield of the sum of iC5 and normal pentane (nC5) (collectively iC5 and nC5 may be referred to as "paraffin C5"), and C5 olefin for a methane co-feed and for an isopentane co-feed. As depicted, the paraffin C5 yield is lower and the C5 olefin yield is higher for co-feeding isopentane as compared to co-feeding methane. Particularly, the isopentane co-feed provides a negative yield of C5 paraffins as compared to co-feeding methane. Although a significant increase of the C5 olefin yield for the isopentane co-feed versus the methane co-feed is observed, the total C5 yield, namely the sum of iC5, nC5, and C5 olefins, is as much as 2 weight percent lower for the isopentane co-feed as compared to the methane co-feed. Lowering the yields of paraffin C5 and C5 olefin are generally desirable for a reformate to lower the vapor pressure of the resulting gasoline.

Figure 5:
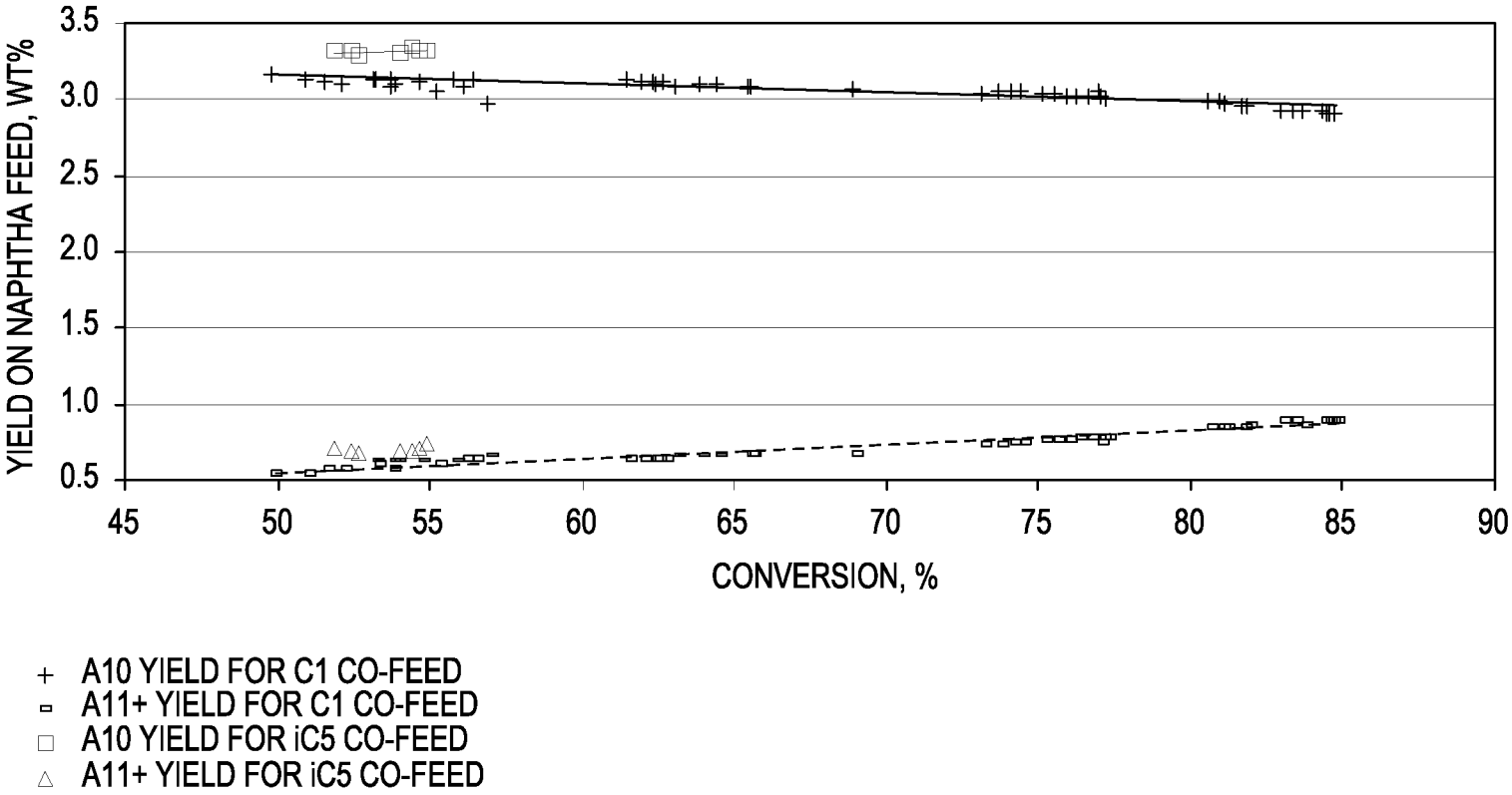
FIG. 5 is a graphical depiction of A10 and $A11^+$ yield versus C7 paraffin conversion.
Figure 6:
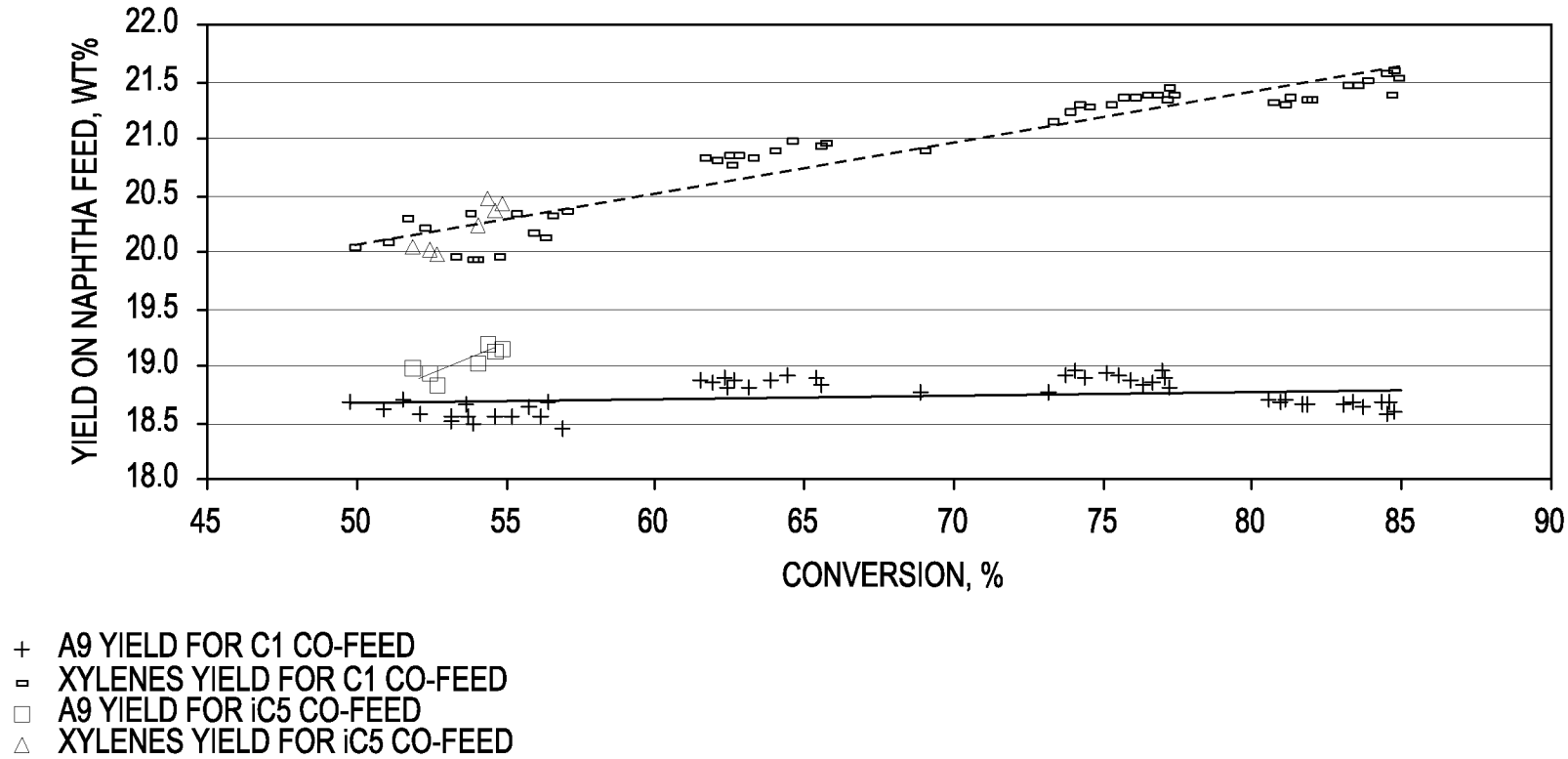
FIG. 6 is a graphical depiction of A9 and xylenes yield versus C7 paraffin conversion.
Figure 7:
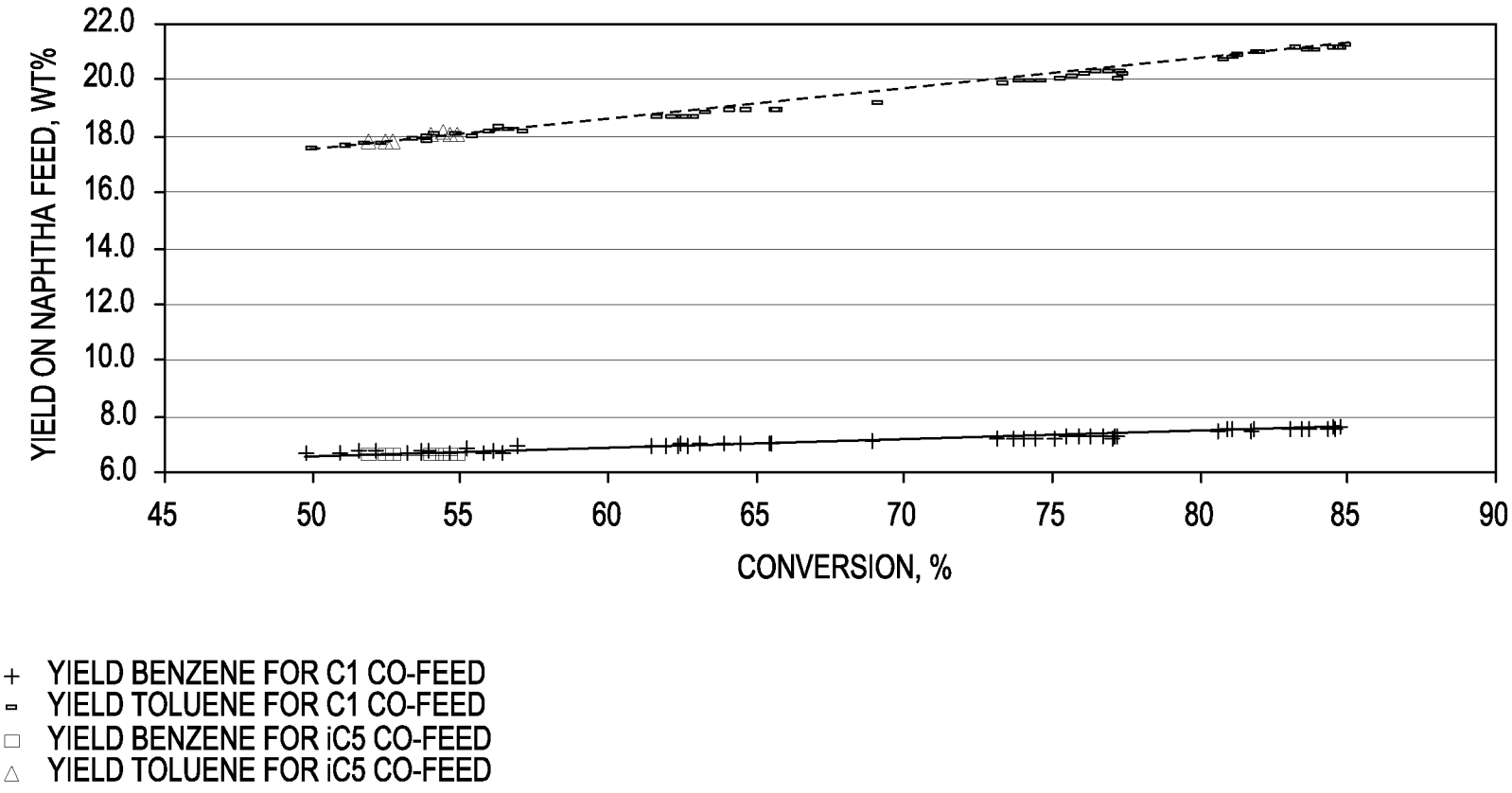
FIG. 7 is a graphical depiction of benzene and toluene yield versus C7 paraffin conversion.

Referring to FIGS. 5-6, a greater yield of, respectively, A10 and $A11^+$, and A9 is obtained for co-feeding isopentane as compared to methane. Referring to FIG. 7, the co-feed of isopentane is generally equivalent to co-feeding methane with respect to benzene and toluene yields. As such, it appears that the total increase in total aromatics is primarily due to increased production of $C9^+$. Moreover, benzene, toluene, and xylene yields do not appear to be impacted by the co-feeding of isopentane. As such, the co-feeding of isopentane can be particularly advantageous in production of heavier aromatics over the production of benzene, toluene, and xylenes. Moreover, the benefit of co-feeding isopentane can be particularly advantageous if existing isopentane is available to provide to the reforming unit without additional capital expense Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius, all parts and percentages are by weight, and all pressure units are absolute, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A reforming process to reduce production of pentane and increase production of aromatics comprising: combining a stream having an effective amount of isopentane and a stream having an effective amount of naphtha for reforming, wherein the naphtha has not less than about 95%, by weight, of one or more compounds having a boiling point of about 38-about 260° C. as determined by ASTM D89-07;

introducing the combined stream to a reforming reaction zone wherein the combined stream has an isopentane: naphtha mass ratio of about 0.10:1.00-about 1.00:1.00; and reforming the combined stream to produce reformate.

2. The process according to claim 1, wherein the combined stream has an isopentane:naphtha mass ratio of about 0.20: 1.00-about 0.50:1.00.

3. The process according to claim 1, wherein the reforming reaction zone has a temperature of about 300-about 550° C.

4. The process according to claim 1, wherein the reforming reaction zone has a temperature of about 470-about 550° C.

5. The process according to claim 1, wherein the reforming reaction zone has a pressure of about 340-about 5,000 kPa and a liquid hourly space velocity based on a naphtha feed of about 0.1-about 20 $hr^{-1}$.

6. The process according to claim 1, wherein the reforming reaction zone has a liquid hourly space velocity based on a naphtha feed of about 0.5-about 5.0 $hr^{-1}$.

7. The process according to claim 1, further comprising providing a stream having an effective amount of hydrogen for reforming to the reforming reaction zone.

8. The process according to claim 7, wherein the reforming reaction zone has a pressure of about 340-about 5,000 kPa and a liquid hourly space velocity based on a naphtha feed of about 0.1-about 20 $hr^{-1}$, and the combined stream has an isopentane:naphtha mass ratio of about 0.20:1.00-about 0.50: 1.00.

9. The process according to claim 8, wherein the reforming reaction zone has a temperature of about 500-about 550° C.

10. A reforming process to reduce production of pentane and increase production of aromatics comprising:

combining a stream comprising at least about 80% by mole isopentane and a stream comprising at least about 80% by mole naphtha introduced to a reforming reaction zone to generate product comprising at least one aromatic hydrocarbon, wherein the naphtha has not less than about 95%, by weight, of one or more compounds having a boiling point of about 38-about 260° C. as determined by ASTM D86-07 and wherein the combined stream has an isopentane:naphtha mass ratio of about 0.10:1.00-about 1.00:1.00; and reforming the combined stream to produce reformate.

11. The process according to claim 10, wherein the combined stream has an isopentane:naphtha mass ratio of about 0.20:1.00-about 0.50:1.00.

12. The process according to claim 10, wherein the reforming reaction zone has a temperature of about 300-about 550° C.

13. The process according to claim 10, wherein the reforming reaction zone has a pressure of about 340-about 5,000 kPa and a liquid hourly space velocity based on a naphtha feed of about 0.1-about 20 $hr^{-1}$.

14. A reforming process to reduce production of pentane and increase production of aromatics comprising:

combining a first stream comprising at least about 90% by mole isopentane and a second stream comprising at least about 90% by mole naphtha introduced to a reforming reaction zone for reducing the production of one or more C5 hydrocarbons wherein the naphtha has not less than about 95%, by weight, of one or more compounds having a boiling point of about 38-about 260° C. as determined by ASTM D86-07, wherein the combined stream has an isopentane:naphtha mass ratio of about 0.10: 1.00-about 1.00:1.00; and reforming the combined stream to produce reformate and wherein an effluent of the reforming reaction zone comprises at least one aromatic hydrocarbon.

15. The process according to claim 14, wherein the combined stream has an isopentane:naphtha mass ratio of about 0.20:1.00-about 0.50:1.00.

16. The process according to claim 1, further comprising recycling the stream having the effective amount of isopentane from a downstream fractionation zone before combining with the stream having the effective amount of naphtha for reforming.

17. The process according to claim 10, further comprising recycling the stream comprising at least about 80% by mole isopentane from a downstream fractionation zone before combining with the stream comprising at least about 80% by mole naphtha.

18. The process according to claim 14, further comprising recycling the stream comprising at least about 90% by mole isopentane from a downstream fractionation zone before combining with the stream comprising at least about 90% by mole naphtha.

* * * * *